United States Patent [19]

Suska

[11] Patent Number: 4,607,829

[45] Date of Patent: Aug. 26, 1986

[54] CLAMPING APPARATUS

[76] Inventor: Charles R. Suska, R.R. 1, Box 14, Roxbury, Conn. 06783

[21] Appl. No.: 653,922

[22] Filed: Sep. 24, 1984

[51] Int. Cl.[4] ..... B25B 1/20

[52] U.S. Cl. ..... 269/88; 269/152; 269/249

[58] Field of Search ..... 269/69, 88, 99, 100, 269/152–156, 208, 900, 45, 249, 98, 97; 24/341, 486, 525; 248/231.7, 229

[56] References Cited

U.S. PATENT DOCUMENTS

| | | | |
|---|---|---|---|
| 994,630 | 6/1911 | Bergstrom . | |
| 1,126,053 | 1/1915 | McGough | 269/45 |
| 1,179,100 | 4/1916 | Hayes | 248/231.7 |
| 1,319,900 | 10/1919 | Reeder | 269/97 |
| 1,352,647 | 9/1920 | Benton . | |
| 1,469,734 | 10/1923 | Staley | 269/69 |
| 1,546,583 | 7/1925 | Hunter . | |
| 1,659,302 | 2/1928 | Reinhardt | 269/69 |
| 1,973,238 | 9/1934 | Walter | 269/152 |
| 1,987,826 | 1/1935 | Heumann | 269/98 |
| 2,116,263 | 5/1938 | Harbaugh | 269/45 |
| 2,177,395 | 10/1939 | Thompson et al. | 269/208 |
| 2,236,913 | 4/1941 | Merrill | 269/249 |
| 2,311,042 | 2/1943 | Ferguson | 269/98 |
| 2,324,803 | 7/1943 | Snyder | 269/152 |
| 2,606,583 | 8/1952 | O'Connor . | |
| 2,636,527 | 4/1953 | Schiemann . | |
| 2,778,393 | 1/1957 | Golasowski . | |
| 2,816,586 | 12/1957 | Koberle | 269/152 |
| 3,096,961 | 7/1963 | Powell | 248/229 |
| 3,166,307 | 1/1965 | Sego | 269/155 |
| 3,246,867 | 4/1966 | Ewing | 24/486 |
| 3,268,196 | 8/1966 | Anton | 248/229 |
| 4,141,542 | 2/1979 | Wolff . | |
| 4,234,176 | 11/1980 | Goff et al. | 269/156 |
| 4,256,295 | 3/1981 | Egner . | |
| 4,363,475 | 12/1982 | McCarty . | |

FOREIGN PATENT DOCUMENTS

| | | | |
|---|---|---|---|
| 700936 | 12/1953 | United Kingdom | 24/486 |

*Primary Examiner*—Robert C. Watson

*Attorney, Agent, or Firm*—Brumbaugh, Graves, Donohue & Raymond

[57] ABSTRACT

Clamping apparatus includes a plurality of C-clamps formed with at least four spaced holes in their frames. Fasteners inserted through the holes secure juxtaposed C-clamps together in any one of many relationships, whereby a variety of workpieces may be held in desired positions.

5 Claims, 12 Drawing Figures

CLAMPING APPARATUS

BACKGROUND OF THE INVENTION

Conventional C-clamps are used in a variety of ways by mechanics, machinists, welders, constructors, repairers and the like. Each clamp normally provides two clamping surfaces, one fixed and the other adjustable. The fixed surface is located at one end of a C-shaped rigid frame and the adjustable surface is positioned on the other end of the frame by a threaded rod. Rotating the rod varies the distance between the clamping surfaces to accommodate various sizes of workpieces and to apply or release a clamping force.

While widely useful, the lack of flexibility of use offered by the basic C-clamp has led to efforts to provide more versatile clamping arrangements. For example, U.S. Pat. No. 1,352,647 to Benton shows two C-clamps connected at the end of their shanks by a bolt, thereby affording a double clamp adjustable to a variety of positions.

U.S. Pat. No. 2,636,527 to Schiemann discloses the use of so-called male and female C-clamps fastened together with set screws to provide a number of different clamping arrangements.

U.S. Pat. No. 4,363,475 to McCarty illustrates another C-clamp structure in which a C-clamp is provided with a pair of holes cooperating with holes on a plate 19 to orient the C-clamp in one of a number of possible positions.

The above C-clamp structures and others in the prior art all fail to provide a clamping arrangement using C-clamps versatile enough to hold a great variety of workpieces in many desired relationships.

SUMMARY OF THE INVENTION

The present invention is directed to an improved C-clamp apparatus constructed to provide an almost infinite number of holding and clamping positions, thereby permitting workpieces to be orientated in almost any desired arrangement.

More particularly, the inventive C-clamp apparatus includes a plurality of C-clamps, each of which is formed by a frame and having at least one adjustable clamping surface. A plurality of holes are formed in the frames of the C-clamps. To provide a desired C-clamp configuration, two or more of the clamps are juxtaposed in a desired position and fasteners inserted through the holes to secure them together. The adjustable clamping surfaces on the plurality of clamps can then be actuated to hold workpieces in a desired manner.

To increase the versatility and capacity of the inventive C-clamp apparatus, one or more of the plurality of clamps may include two adjustable clamping surfaces.

Through use of the inventive C-clamps, clamping, vise functions and the like are readily performed in almost any desired manner. The advantages of being able to have at hand such a versatile tool are self-evident to mechanics, machinists, or the like.

DESCRIPTION OF EXEMPLARY EMBODIMENTS

Figure 1:
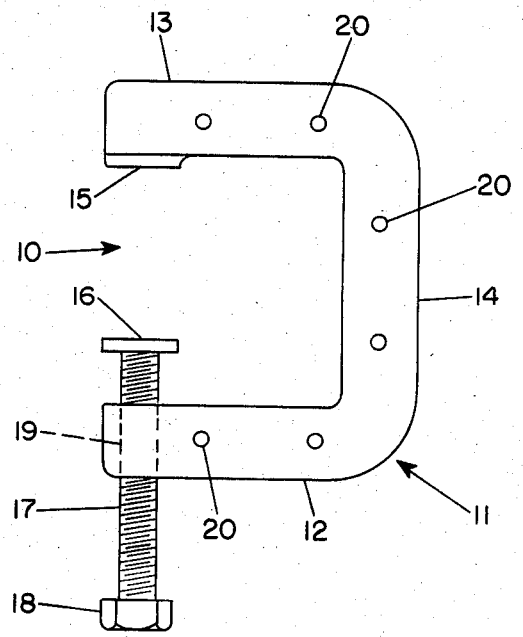
FIG. 1 illustrates a side view of one of the C-clamps used in combination with other C-clamps to form the inventive clamping apparatus.

Referring to the invention in greater detail with reference to FIG. 1, a C-clamp 10 is formed by a frame 11 which includes arms 12 and 13 joined by a shank 14. While shown in the interests of simplicity as made of rectangular steel stock, the frame 11 may be ribbed or flanged to add desired strength characteristics, as is well known in the art. A fixed clamping surface or jaw 15 on the arm 13 faces a movable or adjustable clamping surface 16 pivotally carried by a threaded rod 17 having a suitable actuating device 18 on its other end. The threaded rod 17 passes through a tapped hole 19 in the arm 12.

Spaced holes 20 are formed in a plurality of the sections of the frame, i.e., the arms 12 and 13, and the shank 14, for the purpose of receiving fasteners 21 (FIG. 2) to secure additional clamps 10 together, as will be explained hereinafter. With certain C-clamp configurations, holes may be omitted from a particular frame section or sections when appropriate. While six spaced holes 20 have been found to be a preferred number, and are shown in FIG. 1, a lesser number, but at least four holes, may be used, and a greater number may also be desirable. Four holes is the minimum number necessary to provide the clamps with the required number of desired relationships when fastened together, as discussed below.

Figure 2:
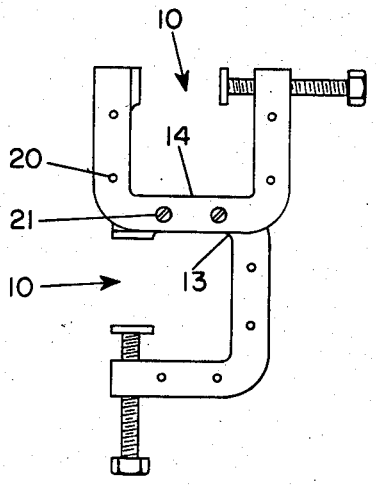
FIG. 2 shows a side view of the inventive clamping apparatus with two C-clamps juxtaposed and fastened together in one possible configuration.
Figure 3:
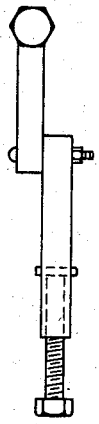
FIG. 3 is an end view of the two C-clamps of FIG. 2.

Referring next to FIGS. 2 through 9, each figure illustrates two of the clamps 10 juxtaposed in a desired relationship. In FIG. 2, the shank 14 of one clamp is positioned over the arm 13 of another clamp. Two of the fasteners 21 are then inserted through the holes 20, the fasteners including a screw and nut combination for securing the C-clamps 10 together. If desired, the lower C-clamp 10 of FIG. 2 may include tapped holes 20 to receive threaded screws passing through larger untapped holes 20 in the upper clamp 10, thereby securing the clamps together.

Figure 4:
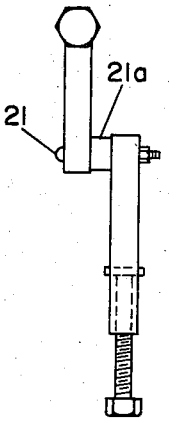
FIG. 4 is an end view of two clamps arranged similarly to the clamps shown in FIG. 2, but with the addition of two spacers between clamps.
Figure 5:
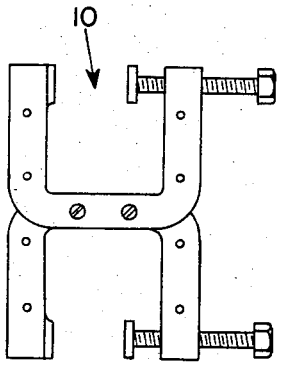
FIGS. 5 through 9 show side views of the inventive apparatus with two C-clamps fastened together in five of the many possible configurations in which the C-clamps can be used.
Figure 6:
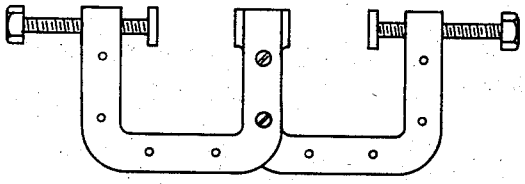
Figure 7:
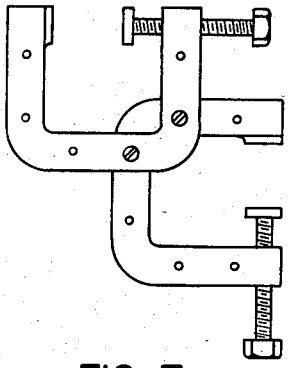
Figure 8:
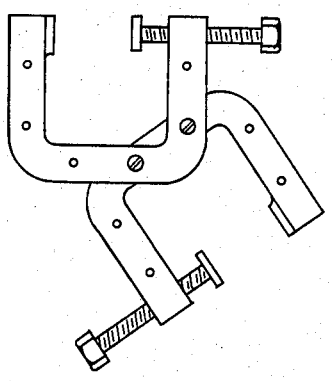
Figure 9:
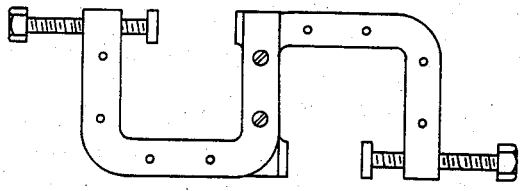

FIG. 4 shows two of the C-clamps juxtaposed in the same relationship as FIG. 2, but with spacers 21a on the fasteners 21 between the two C-clamps to provide for spacing of the clamps a desired distance apart.

FIGS. 5 through 9 show some of the other available relationships between the C-clamps for providing a wide variety of clamping positions for workpieces. Note that in the event flanged clamp frames 11 are used, suitable bosses or the like may be provided at the holes 20 to assure that the C-clamps may be securely fastened together.

While the C-clamps 10 of FIGS. 2, 3, 5–9 and 11 are secured together and are essentially co-planer, the spacers 21*a* may form part of the fasteners 21 to separate the frames 11, as shown in FIG. 4. For example, washers of a desired thickness may be interposed between the C-clamps or tubing of desired lengths may be used as part of the fastening devices to separate the frames a desired distance for holding workpieces appropriately.

Figure 10:
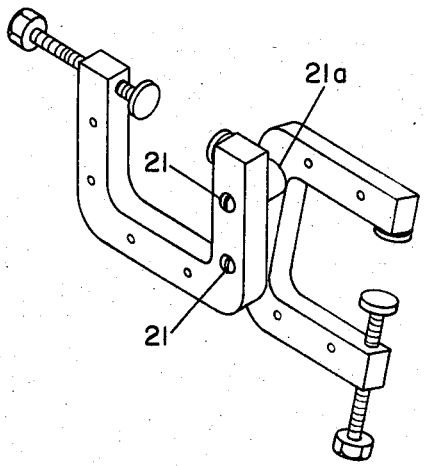
FIG. 10 is a view in perspective of the inventive clamping apparatus in which one of the fasteners holding the clamps together includes a spacing device for suitably orienting the clamps.

In addition to the use of spacers in FIG. 4, a spacer 21a forms part of one of the fasteners 21 in FIG. 10 in order to tilt the C-clamps 10 with respect to each other for holding suitable workpieces.

Figure 11:
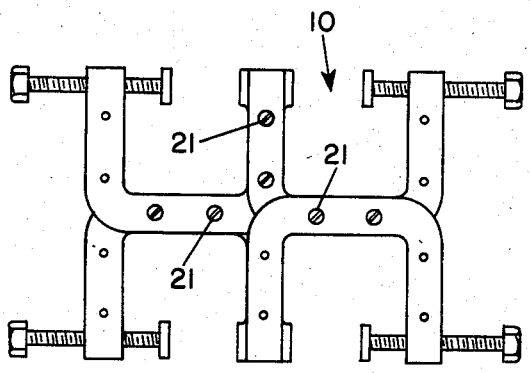
FIG. 11 is a side view of a clamping configuration in accordance with the invention using four C-clamps secured in a desired relationship.

FIG. 11 illustrates the juxtaposition of four C-clamps 10 in a desired relationship by fasteners 21. Of course it is possible to secure three, five or even more of the C-clamps together to provide as many clamping positions as are necessary for any particular task.

While two fasteners 21 have been shown securing the C-clamps together in FIGS. 2 through 11, when lighter work is involved, one fastener can be used for two frames. This enables placing the frames at one of many possible angles by using the single fastener 21 as a pivot.

Figure 12:
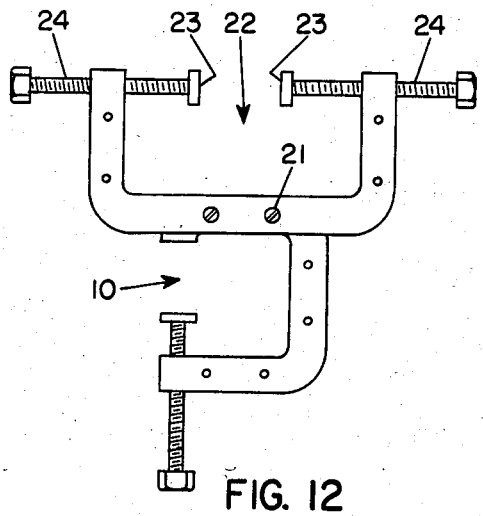
FIG. 12 shows a side view of the inventive clamping apparatus including one C-clamp with an adjustable surface and another differently sized C-clamp with two adjustable clamping surfaces.

FIG. 12 illustrates a C-clamp 22 provided with two adjustable clamping surfaces 23 mounted on threaded rods 24. One of the C-clamps 10 is secured by fasteners 21 to the C-clamp 22 to increase the versatility and capacity of the clamping apparatus. Note that the C-clamps 10 and 22 are differently sized. Such different sizes can also be used in any desired configurations rather than using identically sized clamps as shown in FIGS. 2 through 11.

While the invention has been described with reference to specific embodiments, it will be understood that various changes and modifications may be made within the scope of the invention which is defined in the appended claims.

I claim:

1. Clamping apparatus comprising at least two C-clamps, each of said C-clamps being formed by a frame of three sections and having at least one adjustable clamping surface, at least four holes formed in the frame of one of the C-clamps, two of the holes being located in at least two of the three sections of the frame, at least four holes formed in the frame of the second C-clamp to cooperate with the holes in the first C-clamp, the holes in the one C-clamp and the second C-clamp being spaced so that two holes in the one C-clamp register with two holes in the second C-clamp when the one and second C-clamp are juxtaposed in any one of many desired relationships, and two fasteners adapted to be inserted through the registered holes in the two C-clamps when the C-clamps are juxtaposed to hold the two C-clamps in a desired relationship.

2. Clamping apparatus as defined in claim 1, wherein the C-clamps are identical in size and configuration.

3. Clamping apparatus as defined in claim 1, wherein the plurality of C-clamps includes at least two different sizes of C-clamps.

4. Clamping apparatus as defined in claim 1, wherein the fastener includes a spacing device to separate the C-clamps a desired distance.

5. Clamping apparatus as defined in claim 1, wherein at least one of the C-clamps includes two adjustable clamping surfaces.

* * * * *